US005706880A

United States Patent [19]

Ohnuma et al.

[11] Patent Number: 5,706,880

[45] Date of Patent: Jan. 13, 1998

[54] VACUUM CASTING METHOD AND VACUUM CASTING APPARATUS

[75] Inventors: Hiroshi Ohnuma, Fukuoka-ken; Kimio Kubo, Tochigi-ken; Akira Mikami, Chichibu; Taichi Ikejiri; Katuhiro Kurose, both of Kumagaya; Hiroyuki Hagiwara, Fukaya, all of Japan

[73] Assignee: Hitachi Metals, Ltd., Tokyo, Japan

[21] Appl. No.: 591,818

[22] Filed: Jan. 25, 1996

[30] Foreign Application Priority Data

Feb. 7, 1995 [JP] Japan ..... 7-042480

[51] Int. Cl.[6] ..... B22D 18/06

[52] U.S. Cl. ..... 164/63; 164/255

[58] Field of Search ..... 164/63, 255, 254, 164/119, 306

[56] References Cited

U.S. PATENT DOCUMENTS

| | | | |
|---|---|---|---|
| 4,340,108 | 7/1982 | Chandley et al. . | |
| 4,606,396 | 8/1986 | Chandley et al. . | |
| 4,791,977 | 12/1988 | Chandley . | |
| 4,957,153 | 9/1990 | Chandley . | |
| 5,044,420 | 9/1991 | Vanderjagt . | |
| 5,069,271 | 12/1991 | Chandley et al. | 164/63 |
| 5,174,356 | 12/1992 | Vanderjagt . | |
| 5,509,458 | 4/1996 | Onuma et al. | 164/63 |

FOREIGN PATENT DOCUMENTS

| | | |
|---|---|---|
| 0 580 136 | 1/1994 | European Pat. Off. . |
| 0 640 420 | 9/1994 | European Pat. Off. . |
| 60-56439 | 4/1985 | Japan . |
| WO 94/20240 | 9/1994 | WIPO . |

*Primary Examiner*—Kuang Y. Lin

*Attorney, Agent, or Firm*—Finnegan, Henderosn, Farabow, Garrett & Dunner

[57] ABSTRACT

An apparatus and method for casting metal in an evacuated mold cavity. The apparatus has a preferential suction zone through which a mold can be preferentially and effectively evacuated and a suction head sealingly fitting the upper surface of the mold. To the apparatus, is further provided a pressing means for pressing, in cooperation with the suction head, the mold against the inner bottom surface of a mold support chamber. By evacuating the mold through the preferential suction zone while pressing the mold to the bottom of the mold support chamber, a mold cavity is easily filled with a molten metal in such a manner to avoid casting defects such as insufficient filling, blow hole, surface fold, under fill, etc.

35 Claims, 11 Drawing Sheets

A VICINITY OF MOLD 4
B MOLD CAVITY 7
C RUNNER 60

VACUUM CASTING METHOD AND VACUUM CASTING APPARATUS

BACKGROUND OF THE INVENTION

The present invention relates to a vacuum casting apparatus and a vacuum casting method using the apparatus. More particularly, the present invention relates to an apparatus and a method for casting articles of poor castability such as complicated-shaped or thin stainless steel casting or heat-resistant cast steel, etc.

In the production of a thin cast article having a thin wall of 5 mm thick or less, the fluidity of a molten metal introduced into a mold cavity is rapidly decreased because a part of the molten metal is rapidly cooled and easily solidified upon coming into contact with the internal wall of the mold cavity. This results in defects such as insufficient filling of the mold cavity, etc. In the production of a cast article of complicated shape, air and gases generated from the mold material are likely to be introduced into the resulting cast articles as defects such as blow holes. Thus, a defectless cast article which has a thin wall and complicated shape is difficult to be produced.

As a method of producing a thin cast article having complicated shape, a lost wax process has been known. In this method, a ceramic mold is heated to 700°–900° C. prior to the filling of the cavity with a molten metal to retard the cooling of the molten metal introduced into the cavity, thereby keeping the molten metal highly flowable. However, since a ceramic mold is expensive, the production cost of a thin cast article having a complicated shape would be extremely high.

As an alternative method, JP-A-60-56439 discloses a gypsum mold provided with a cavity, runner, etc., in which a refractory filter having a gas permeability higher than that of the gypsum is disposed in an area ranging from the neighborhood of a last-to-fill part of the cavity to the outside surface of the gypsum mold, thereby enhancing the evacuation capability to increase the fluidity of the molten metal and prevent the defect due to gas. The gypsum mold is produced by hydration-setting a gypsum slurry and drying the hardened gypsum. This method utilizing the gypsum mold, as is the case of the lost wax process mentioned above, has been known as one of the precision casting methods for producing a cast article of a high dimensional accuracy, and has been used for producing dies, parts for machines, artistic handicrafts, etc.

However, since the production of a gypsum mold includes the steps of kneading, pouring, hydration setting, pattern draw, drying, etc. which take a long period of time over 48 hours, the productivity of this method is poor. Further, since the gas permeability of the gypsum mold is extremely low, it leads to difficulties in determining the casting design for evacuation and pressurization at filling of a cavity with a molten metal. In addition, since the cooling rate of a gypsum mold is low, the molten metal in the mold solidifies extremely slowly. Therefore, in the case of casting a thin article of complicated shape, a shrinking defect is likely to occur, resulting in a low yield of the desired cast article.

Recently, a vacuum casting method as disclosed in U.S. Pat. Nos. 4,340,108, 4,606,396, etc. has come to be used. In this method, a molten metal is introduced into a mold cavity by evacuating a mold. However, in this method, air is likely to be incorporated into the molten metal through a mold portion which is not immersed in the molten metal, failing to obtain a sufficient vacuum. Further, although it is applicable to casting of articles of low height and simple shape, it is difficult to be applied to casting of high and thick articles of complicated shape.

U.S. Pat. No. 4,957,153 discloses a vacuum casting method in which a mold is supported in an inverted casting position in an open bottom container with a particulate bed compacted about the mold, and the mold is immersed into a molten metal thereby introducing a molten metal into the mold. In this method, however, since a mold is immersed in a molten metal together with the particulate bed compacted about it, the molten metal is disturbed before and after the immersion of the mold to cause an incorporation of air into the molten metal. Further, since the mold and particulate bed compacted around it project out of the container, air is likely to be incorporated into the molten metal from the bottom portion of the mold.

U.S. Pat. No. 4,791,977 discloses a metal casting apparatus which has a mold having a mold cavity therein and a fill passage The fill passage vertically extends in the mold supported in the mold support chamber and its upper end is sealed with a porous plug highly permeable to gas but not to metal. The molten metal flows to the mold cavity from the fill passage by maintaining the upper end of the fill passage at a lower pressure than the pressure in the vacuum chamber surrounding the mold. However, since the chamber is evacuated from the upper portion of the fill passage, the last-to-fill part of cavity, riser, run-off, etc. is not sufficiently evacuated, thereby failing to completely fill the cavity, etc. with a molten metal.

U.S. Pat. No. 4,791,977 further discloses that mold wall movement, metal penetration into the mold face and outright mold failure can be avoided by maintaining the upper part of the fill passage, which extends vertically in the gas-permeable mold and communicates laterally with other cavities, at a lower pressure than the pressure in the vacuum chamber surrounding the mold. In this method, however, the free surface of the molten metal receives an extra force other than a countergravitational force during flowing to the mold cavity from the fill passage due to the selective differential pressure. As a result thereof, the flow of the molten metal is disturbed to cause molding defect such as blow hole, pin hole, etc. Further, it is quite difficult to maintain, during filling of the mold with a molten metal, the upper part of the fill passage at a pressure lower than the pressure in the support chamber external to the mold to an intended extent. Also, the differential pressure reducing means complicate the vacuum means to fail to provide a high vacuum speed required for producing a thin cast article. In addition, since the molten metal begins to flow to the mold cavity after filling the fill passage, the temperature of the molten metal is lowered to cause, particularly in a thin mold cavity, a defect such as insufficient filling, blow hole, surface fold, etc.

Some of the inventors have proposed in United States patent application Ser. No. 08/331,547 a vacuum casting apparatus comprising (a) a vacuum vessel having at least one opening at the bottom thereof; (b) a mold disposed in the vacuum vessel and having a runner and a mold cavity communicating with the runner, the runner having an opening at the opening of the vacuum vessel; and (c) a vacuum means communicating with the vacuum vessel; wherein a suction recess having an opening on the top surface of the mold is disposed in the vicinity of a portion of the mold cavity which is most distant from the opening of the runner and which is lastly filled with a molten metal of casting material, and wherein the suction recess is so disposed that a distance between the bottom of the suction recess and the portion of the mold cavity is smaller than a distance between the outer surface of the mold and any other portions of the mold cavity, thereby rapidly filling the mold cavity with the molten metal. However, this vacuum casting apparatus is still required to be improved to raise the productivity.

OBJECT AND SUMMARY OF THE INVENTION

Accordingly, an object of the present invention is to provide a vacuum casting apparatus and method suitable for producing a cast article, particularly a thin cast article having a complicated shape in a good productivity without suffering from casting defects such as insufficient filling of the cavity with a molten metal, blow holes, etc.

As a result of the intense research in view of the above objects, the inventors have found that a suction head can be maintained to sealingly fit the upper surface of a mold in spite of the tolerance in the mold size by evacuating the mold through a preferential suction zone located in the vicinity of the top of a mold cavity in the mold disposed in a mold support chamber while pressing the mold to the bottom of the mold support chamber by a suction head disposed at an upper opening of the mold support chamber so as to fit the upper surface of the mold, and that the productivity of a thin cast article can be increased by the vacuum casting apparatus with this structure. The present invention has been accomplished by these findings.

Thus, a first vacuum casting method of the present invention comprises the steps of (a) disposing a mold having a runner and a mold cavity communicating with the runner in a mold support chamber having an upper opening and a bottom opening so that the lower open end of the runner is positioned below the bottom opening; (b) forming a preferential suction zone in the vicinity of the top of the mold cavity; (c) placing a suction head in the upper opening of the mold support chamber so that the lower open end of the suction head completely covers the preferential suction zone and sealingly fits the outer upper surface of the mold; and (d) evacuating the mold through the preferential suction zone while pressing the mold toward the inner bottom surface of the mold support chamber, thereby filling the mold cavity with a molten metal through the runner.

A first vacuum casting apparatus of the present invention comprises (a) a mold support chamber having an upper opening and a bottom opening; (b) a mold having a runner and a mold cavity communicating with the runner, the mold being disposed in the mold support chamber so that the lower open end of the runner is positioned below the bottom opening; (c) a preferential suction zone formed in the vicinity of the top of the mold cavity; (d) a suction head placed in the upper opening of the mold support chamber so that the lower open end of the suction head completely covers the preferential suction zone and sealingly fits the outer upper surface of the mold; (e) a pressing means for pressing, in cooperation with the suction head, the mold toward the inner bottom surface of the mold support chamber; and (f) a vacuum means communicating with the suction head, for evacuating the mold to fill the mold cavity with the molten metal while pressing the toward the inner bottom surface of the mold support chamber.

A second vacuum casting method of the present invention comprises the steps of (a) disposing a mold having a runner and a mold cavity communicating with the runner through a plurality of filling passages in a mold support chamber having an upper opening and a bottom opening so that the lower open end of the runner is positioned below the bottom opening; (b) forming a preferential suction zone in the vicinity of the top of the mold cavity; (c) placing a suction head in the upper opening of the mold support chamber so that the lower open end of the suction head completely covers the preferential suction zone and sealingly fits the outer upper surface of the mold; (d) evacuating the mold through the preferential suction zone while pressing the mold toward the inner bottom surface of the mold support chamber, thereby filling the mold cavity with a molten metal through the runner.

A second vacuum casting apparatus of the present invention comprises (a) a mold support chamber having an upper opening and a bottom opening; (b) a mold having a runner and a mold cavity communicating with the runner through a plurality of filling passages, the mold being disposed in the mold support chamber so that the lower open end of the runner is positioned below the bottom opening; (c) a preferential suction zone formed in the vicinity of the top of the mold cavity; (d) a suction head placed in the upper opening of the mold support chamber so that the lower open end of the suction head completely covers the preferential suction zone and sealingly fits the outer upper surface of the mold; (e) a pressing means for pressing, in cooperation with the suction head, the mold toward the inner bottom surface of the mold support chamber; and (f) a vacuum means communicating with the suction head, for evacuating the mold to fill the mold cavity with the molten metal while pressing the toward the inner bottom surface of the mold support chamber.

DETAILED DESCRIPTION OF THE INVENTION

The present invention will be described below more in detail.

[1] Cast Steel

The vacuum casting apparatus and vacuum casting method of the present invention are preferably applied to producing a cast steel from a molten metal of steel which has a high molten metal temperature and is difficult to be cast into a thin cast article. A cast steel produced by the vacuum casting apparatus and vacuum casting method has a high heat resistance and a high oxidation resistance. The composition of such a cast steel is, for example, as follows:

C: 0.05–0.45 weight %,

Si: 2 weight % or less,

Mn: 1 weight % or less,

Cr: 16–25 weight %,

W: 3 weight % or less,

Ni: 8 weight % or less,

Nb and/or V: 1 weight % or less, and

Fe and inevitable impurities: balance.

Another example of the composition is:

C: 0.20–0.60 weight %,

Si: 2 weight % or less,

Mn: 1 weight % or less,

Cr: 15–30 weight %,

W: 6 weight % or less,

Ni: 8–20 weight %, and

Fe and inevitable impurities: balance.

A cast steel having the above composition has, in addition to a usual α-phase, a so-called α'-phase (α-phase+carbides) transformed from γ-phase. The area ratio of α'-phase is preferred to be 20–90% based on the combined area of α-phase and α'-phase.

[2] First vacuum casting apparatus and vacuum casting method

The vacuum casting apparatus and vacuum casting method of the first embodiment of the present invention will be described below with reference to FIGS. 1–4.

Figure 1:
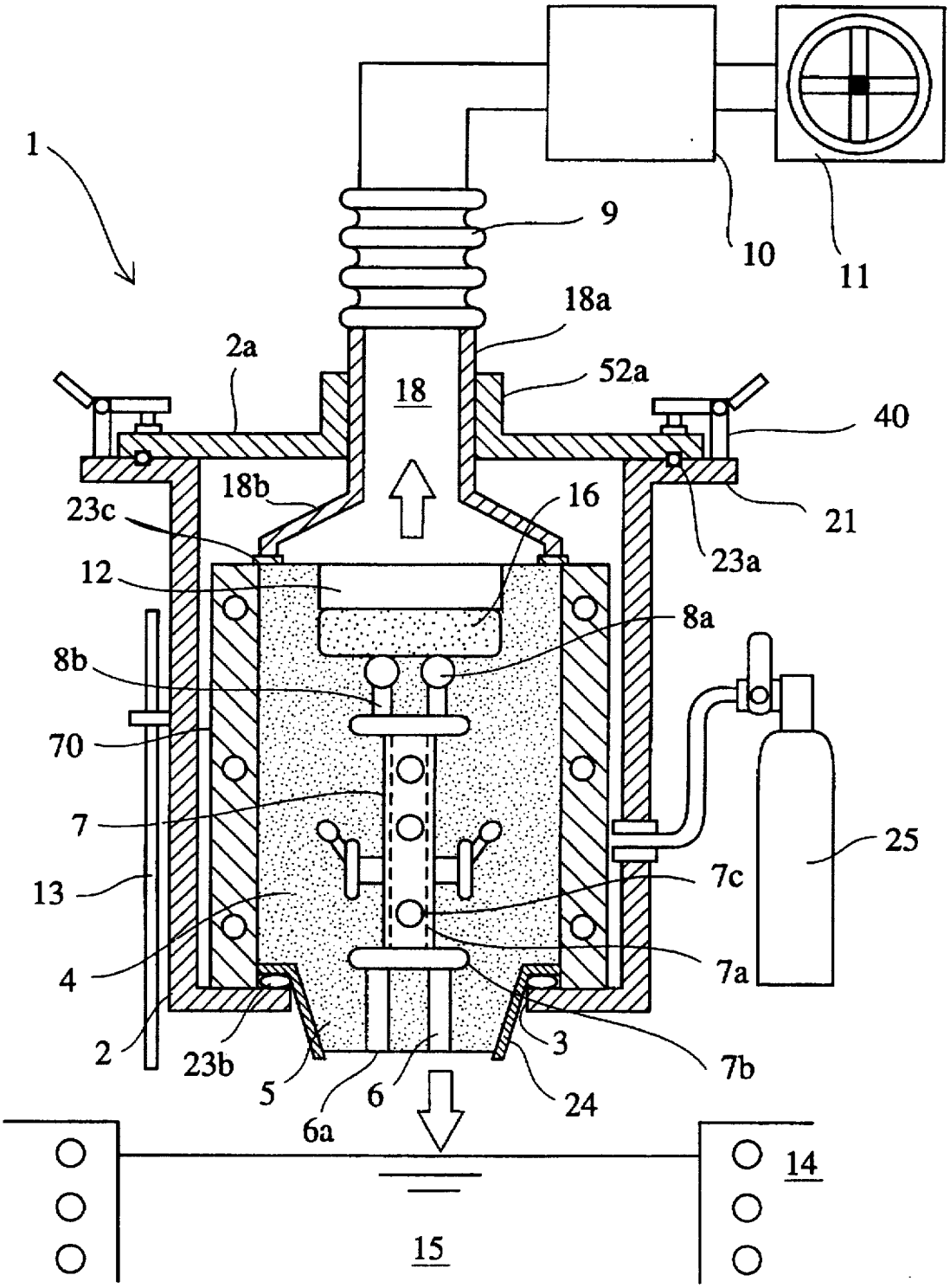
FIG. 1 is a partial cross sectional view showing a vacuum casting apparatus according to the first embodiment of the present invention.

In FIG. 1, the vacuum casting apparatus 1 has a mold support chamber 2 having an opening 3 at its bottom, and a mold 4 having therein a mold cavity 7, runner 6, etc. and supportedly disposed in the mold support chamber 2 by a clamp 70 surrounding the side surface of the mold 4. The mold support chamber 2 is evacuated from the upper side thereof to suck a molten metal 15 from a runner opening 6*a* at a lower end of the mold 4 thereby filling the mold cavity 7. More specifically, the mold support chamber 2 (made of iron and having a 600 mm inner diameter and 800 mm height, for example) has an opening 3 at the bottom thereof, and a cover 2*a* on an upper flange 21 so as to hermetically seal the mold support chamber 2 by a sealing means 40. The cover 2*a* has in its center portion an opening 52*a* which slidably receives a suction head 18*a*. The suction head 18*a* is connected to a flexible tube 9 which is connected to a vacuum means 11 such as a vacuum pump, etc. via a vacuum regulating means 10.

The mold support chamber 2 has the mold 4 mounted therein. In the present invention, the mold 4 made of silica sand, etc. is preferable in view of the castability and gas permeability. For example, a split sand mold consisting of two vertical sections, which is molded by cold box process from silica sand #7, is preferred. The mold 4 has at its lower end a molten metal entrance portion 5 projecting downward and is disposed in the mold support chamber 2 so that the molten metal entrance portion 5 projects downward through the opening 3.

In the mold 4, the runner 6 having, for example, a cross-section of 10 mm×100 mm, extends vertically from the bottom of the molten metal entrance portion 5 to communicate with the mold cavity 7. The mold cavity 7 may be of a structure comprising a pipe portion 7*a* having an outer diameter of 60 mm, a length of 200 mm and a wall thickness of 2.5 mm, a, flange portion 7*b* having an outer diameter of 80 mm and a wall thickness of 3 mm, and a plurality of boss portions 7*c* projecting out of the pipe portion 7*a* and having an outer diameter of 10 mm and a height of 20 mm. It should be noted that the shape of the mold cavity 7 is not restricted to that described above. The inner surface of the mold cavity 7 is preferred to be coated with a mold coating in a thickness of 0.01–4 mm, preferably about 0.15 mm. On the upper end of the mold cavity 7, a riser 8*a* (also serves as a run-off) and a gate 8*b* are provided. The mold support chamber 2 and the cover 2*a*, and the mold support chamber 2 and the lower portion of the mold 4 are in contact with each other via packings 23*a* and 23*b* respectively for maintaining the mold support chamber 2 hermetically sealed and preventing the leakage form the mold cavity 7.

In the upper portion of the mold 4 facing the vacuum side and in the vicinity of the riser 8*a*, a preferential suction zone for preferentially evacuating the mold cavity 7 therethrough. An example for such a preferential suction zone may include a suction recess 12 formed by concavely cutting out the upper portion of the mold 4 toward the riser 8*a* as shown in FIG. 1. The bottom of the suction recess 12 is preferred to be so close to the riser 8*a* that the mold portion between the bottom of the suction recess 12 and the riser 8*a* is not broken due to a mechanical or thermal shock during the casting process. Specifically, the distance between the bottom of the suction recess 12 and the riser 8*a* is preferred to be about 15–30 mm. The diameter of the suction recess 12 is not specifically restricted unless the mechanical strength of the mold 4 is deteriorated, and may be determined based on the size of the mold cavity 7, the riser 8*a*, etc. For example, the suction recess 12 may have a diameter of about 300 mm. The side of the suction recess 12 may be surrounded by a gas-impermeable or slightly gas-permeable tubular member downwardly extending toward the uppermost portion of the hard-to-fill or last-to-fill part such as riser 8*a*, etc. to effect the evacuation through the bottom surface of the suction recess 12. Further, a porous member, block, etc. which have higher gas-permeability than the body portion of the mold 4 may be disposed in the suction recess 12 as will be described below.

In the vacuum casting apparatus shown in FIG. 1, a porous member 16 having a gas permeability higher than that of the body portion of the mold 4 is disposed between the bottom of the suction recess 12 and the riser 8*a* (last-to-fill part) into which the molten metal 15 is finally introduced. The porous member 16 is preferred to be formed by compacting, for example, a molding sand coarser than the molding material of the mold 4 into a disc, plate, etc. The porous member 16 may be formed as an integral part of the mold 4 or as a separate part.

It is necessary that the gas permeability of the porous member 16 is higher than that of the mold 4, and preferably, the former is higher about 3 . 30 times the latter. For example, when a mold is formed of silica sand #6 (gas permeability: 261), the porous member 16 is preferred to be formed of silica sand #5 (gas permeability: 785). When the mold is formed of zircon (gas permeability: 48), the porous member 16 is preferred to be formed of silica sand #4 (gas permeability: 1130). The gas permeability mentioned above was measured according to JIS Z 2603-1976 (test method for gas permeability of molding sand).

The suction head 18 is connected to the flexible tube 9 and comprises a tubular part 18*a* which slidably and sealingly contacts with the opening 52*a* and a lower flared part 18*b* which is sealingly fits the upper surface of the mold 4 through a packing 23*c*. With this structure, the mold cavity 7 is effectively and mainly evacuated through the suction recess 12 when the pressure in the suction head 18 is reduced.

Figure 2:
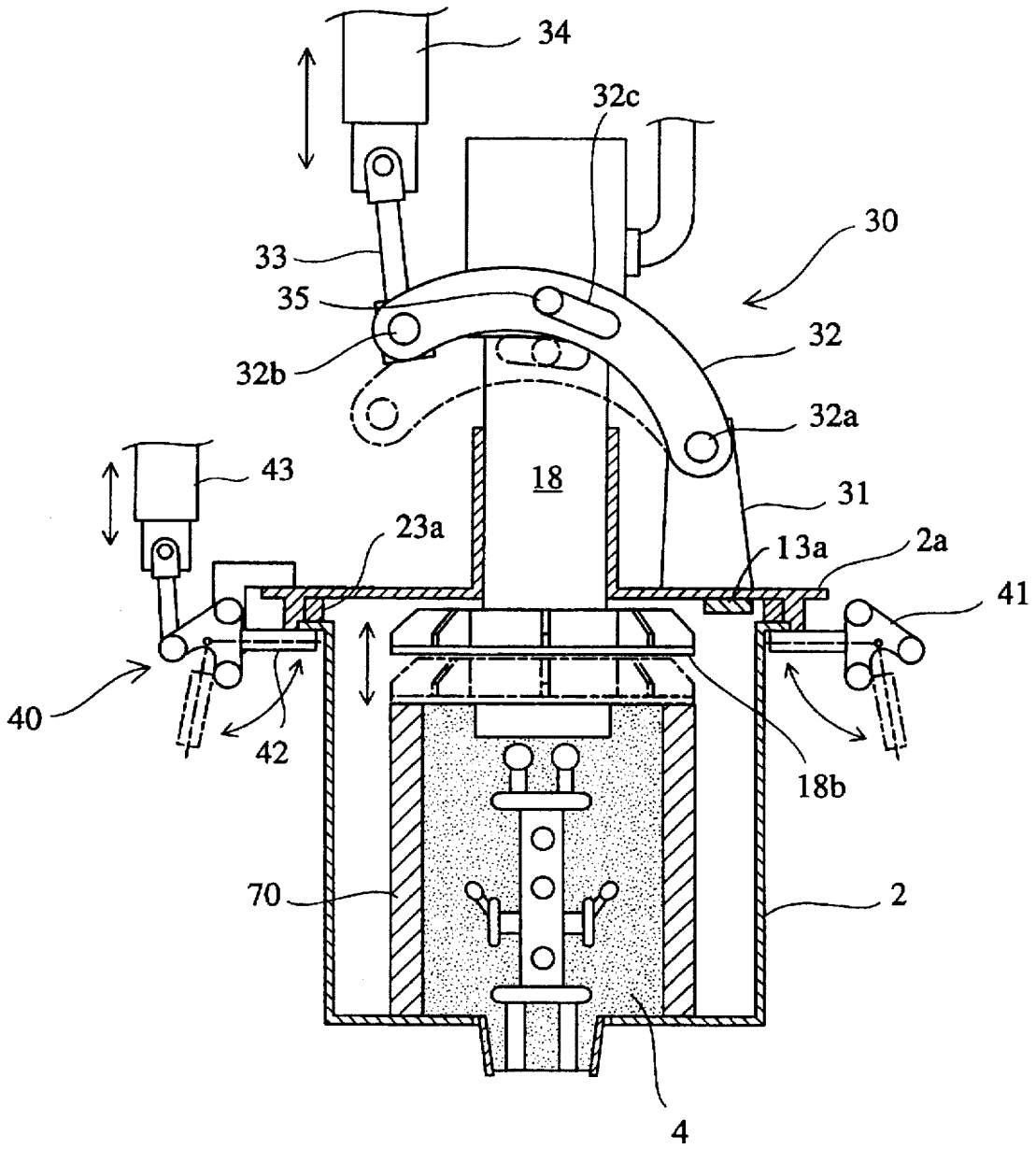
FIG. 2 is a partial cross sectional view showing a pressing means for a suction head.

As shown in FIG. 2, a pressing means 30 for pressing the mold 4 against the bottom of the mold support chamber 2 is cooperatably attached to the suction head 18. The pressing means 30 has a means such as an air cylinder for continuously applying a constant pressure to the suction head 18. The pressing means 30 exemplified by FIG. 2 comprises a pair of brackets 31 fixed to the upper surface of the cover 2*a*, a pair of levers 32 pivotably attached to each bracket 31 by a shaft 32*a*, a link 33 pivotably attached to the pair of levers 32 by a shaft 32*b* and an air cylinder 34 pivotably attached to the link 33. Each lever 32 is provided at the central portion with a slot 32*c* in which a guide pin 35 fixed to the suction head 18 is fitted in slidable relation. When the air cylinder 34 moves downward, the lever 32 pushes the suction head 18 downward via the guide pin 35 to apply a constant downward pressure to the mold 4. With this structure, a constant downward pressure is applied to the mold 4 in spite of a tolerance in the height of the mold 4. Further, this structure is applicable to another mold of variant height only by changing the stroke of the air cylinder 34. The pressure downwardly pressing the mold 4 toward the bottom of the mold support chamber 2 is composed of a force from the lever 32 and a force generated by the difference between the pressure in the mold support chamber surrounding the mold 4 and the pressure in the mold 4. If the pressing force is applied by a spring, a different spring is necessary for each mold of different height to apply the same pressing force because a spring applies different forces to molds of different heights. Further, in some case, the fixed portion of the suction head 18 should be changed depending on the height of the mold.

The mold support chamber 2 is sealed with the cover 2*a* by a sealing means 40. The sealing means 40 comprises a pivotable part 41 attached to the cover 2*a* by means of a suitable fixture, a locking lever 42 fixed to the pivotable part 41, and an air cylinder 43 pivotably attached to the pivotable part 41. When the air cylinder 43 moves upward, the pivotable part 41 rotates to separate the locking lever 42 from the flange of the mold support chamber 2. When the air cylinder 43 moves downward, the pivotable part 41 rotates in the opposite direction to firmly press the locking lever 42 to the flange of the mold support chamber 2. Thus the cover 2*a* is firmly pressed to the flange portion of the mold support chamber 2 by means of the sealing means 40. A seal 23*a* is provided between the cover 2*a* and the mold support chamber 2 to hermetically seal the mold support chamber 2.

Nearly the whole side surface of the mold 4 is supportedly covered with the clamp 70. The clamp 70 prevents the mold 4 from being evacuated from the side thereof, and as a result, no excessive pressure gradient is generated in the mold 4 in the lateral direction.

Returning to FIG. 1, a sensor 13 for detecting the surface of a molten metal 15 in a melting furnace 14 is provided on the outer side of the mold support chamber 2. The bottom surface of the mold 4 and the lateral side of the molten metal entrance portion 5 projecting downward from the bottom of the mold 4 may be covered with a protecting plate 24 made of, for example, a steel. Since the lower part of the protecting plate 24 projects downward through the opening 3 of the mold support chamber 2, the protecting plate 24 is immersed into the molten metal 15 in the melting furnace 14 together with the molten metal entrance portion 5. The protecting plate 24 enhances the strength of the molten metal entrance portion 5 and maintains the runner 6 at a reduced pressure. Further, the incorporation of air into the molten metal through the side of the molten metal entrance portion 5 can be avoided.

The casting by the vacuum casting apparatus 1 shown in FIG. 1 is operated by immersing the molten metal entrance portion 5 of the mold 4 into the molten metal 15 in the melting furnace 14. When the sensor 13 attached to the outer side of the mold support chamber 2 detects the immersion of the molten metal entrance portion 5 into the molten metal 15, the downward moving of the mold support chamber 2 is ceased while the evacuation by the vacuum means 11 is initiated. The mold cavity 7 is evacuated through the suction recess 12 to remove air therein and then the molten metal rising the runner 6 rapidly flows into the mold cavity 7. The vacuum degree of the mold cavity 7 can be regulated by changing the distance between the suction recess 12 and the riser 8*a*.

The vacuum casting apparatus may be equipped with a gas-supplying means 25 for supplying an inert gas under pressure into the mold support chamber 2. The atmosphere in the mold support chamber 2 is purged by and replaced with the inert gas. The preferred inert gas includes nitrogen gas, argon gas, etc. The vacuum casting apparatus having the gas-supplying means 25 may be operated as follows. First, the atmosphere in the mold support chamber 2 is replaced with an inert gas supplied by the gas-supplying means 25. Then, the mold support chamber 2 having the mold 4 therein is moved downward to immerse the molten metal entrance portion 5 into the molten metal 15 in the melting furnace 14, followed by sucking the molten metal 15 into the runner 6 by evacuating the mold cavity 7.

Figure 3:
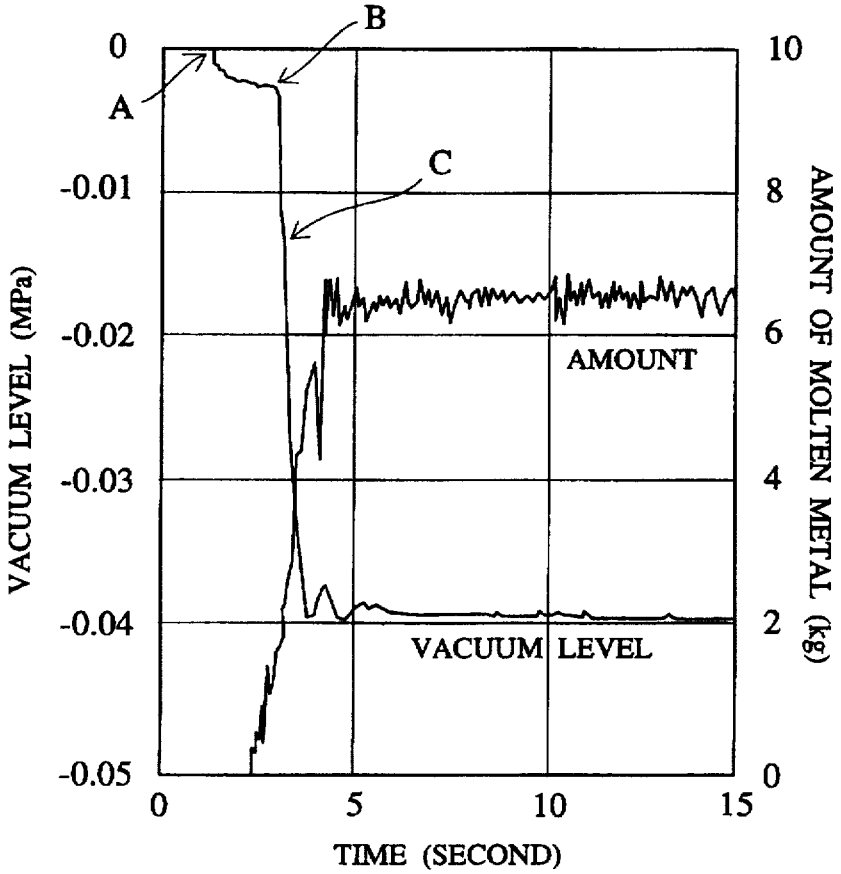
FIG. 3 is a graph showing the change with time of the vacuum degree in a mold support chamber and the amount of a molten metal flowing into a mold cavity in vacuum casting operation.

The immersion of the molten metal entrance portion 5 into the molten metal 15 may be detected by a pressure sensor 13*a* (as shown in FIG. 2) in place of the sensor 13, which detects the pressure change in the mold support chamber 2. FIG. 3 is a graph showing the change with time of the vacuum level in the mold support chamber 2 and the amount of the molten metal 15 flowing into the mold cavity 7 in vacuum casting operation. Each point indicated by A, B or C is the vacuum level before beginning the casting operation, when the runner opening 6*a* reaches the surface of the molten metal 15, or during the casting operation. As shown in FIG. 3, since the runner opening 6*a* does not reach the surface of the molten metal 15, only a slight atmospheric flow is detected in the mold support chamber 2 (point A to point B). Then, the mold support chamber 2 downwardly moves toward the molten metal 15, and when the runner opening 6*a* reaches the surface of the molten metal 15, the mold support chamber 2 is rapidly evacuated to a high vacuum level (point B). When the runner opening 6*a* reaches the predetermined depth, the evacuating speed is increased (point C). When the mold cavity 7 is filled with the molten metal 15, the vacuum level remains constant and the vacuum means 11 is ceased to be run. The molten metal 15 in the mold cavity 7 is allowed to solidify for a predetermined period of time. After solidification, the mold support chamber 2 is then upwardly moved outside the molten metal 15 in the melting furnace 14. This method includes no consumptive supplies such as the sensor 13 and makes the construction of the apparatus simple.

Figure 4:
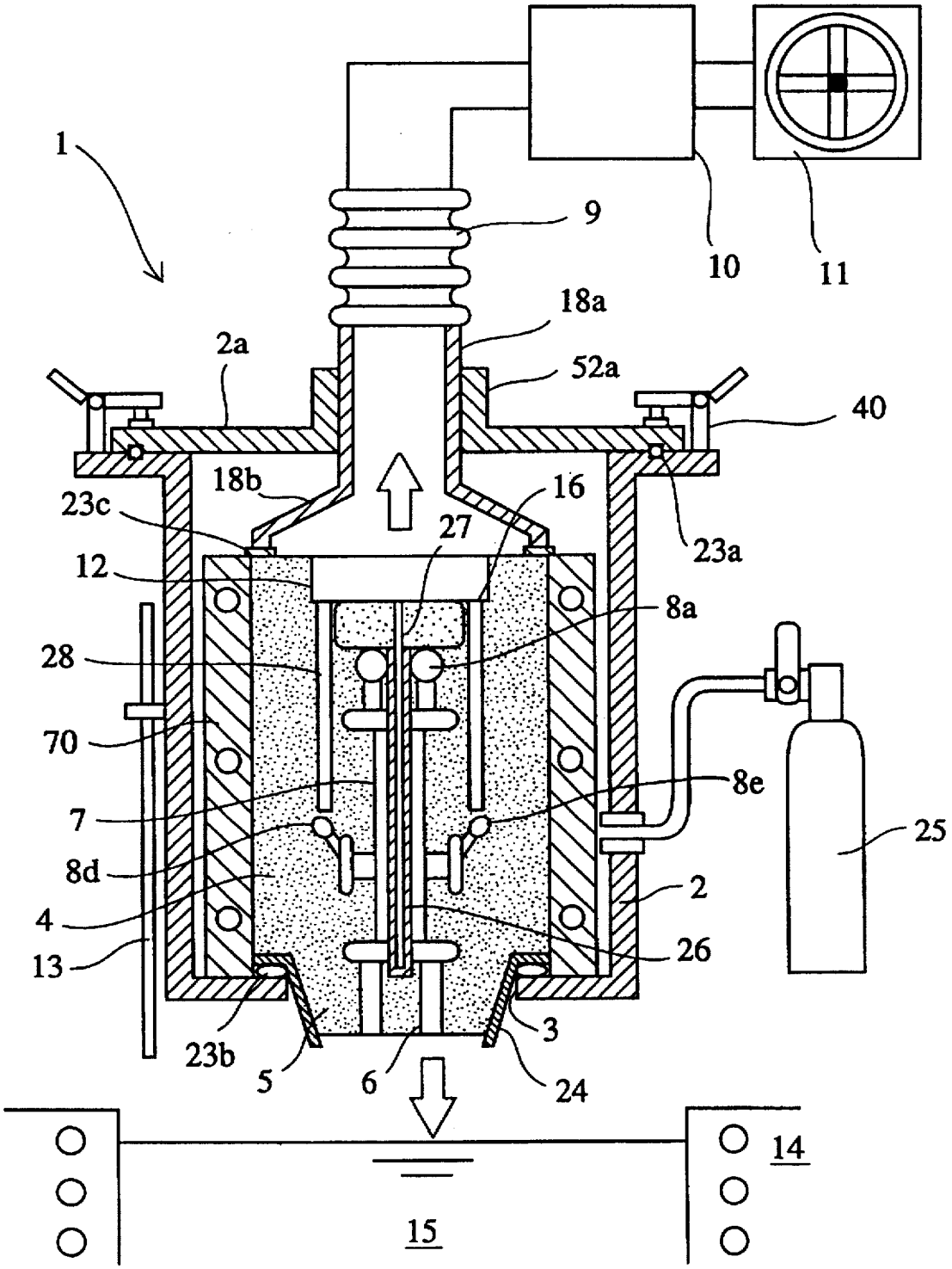
FIG. 4 is a partial cross sectional view showing another vacuum casting apparatus according to the first embodiment of the present invention.

In the vacuum casting apparatus of FIG. 4, a hollow core 26 is disposed within the mold cavity 7. Since the hollow space of the core 26 is communicated with the thin through-hole 27 vertically extending through the porous member 16 and opens at the bottom of the suction recess 12, the suction force directly acts to the interior of the core 26. The mold 4 has narrow suction ducts 28 extending from the bottom of the suction recess 12 to the vicinity of last-to-fill (hard-to-fill) portions 8*d* and 8*e* of the mold cavity 7. The core 26 and the ducts 28 aid in rapid and entire filling of the portion around the core 26 and the last-to-fill portions 8*d* and 8*e* with the molten metal. The vacuum casting apparatus shown in FIG. 4 may be operated in the same manner as in the vacuum casting apparatus shown in FIG. 1.

[3] Second vacuum casting apparatus and vacuum casting method

The vacuum casting apparatus and vacuum casting method of the second embodiment of the present invention will be described below with reference to FIGS. 5–10.

Figure 5:
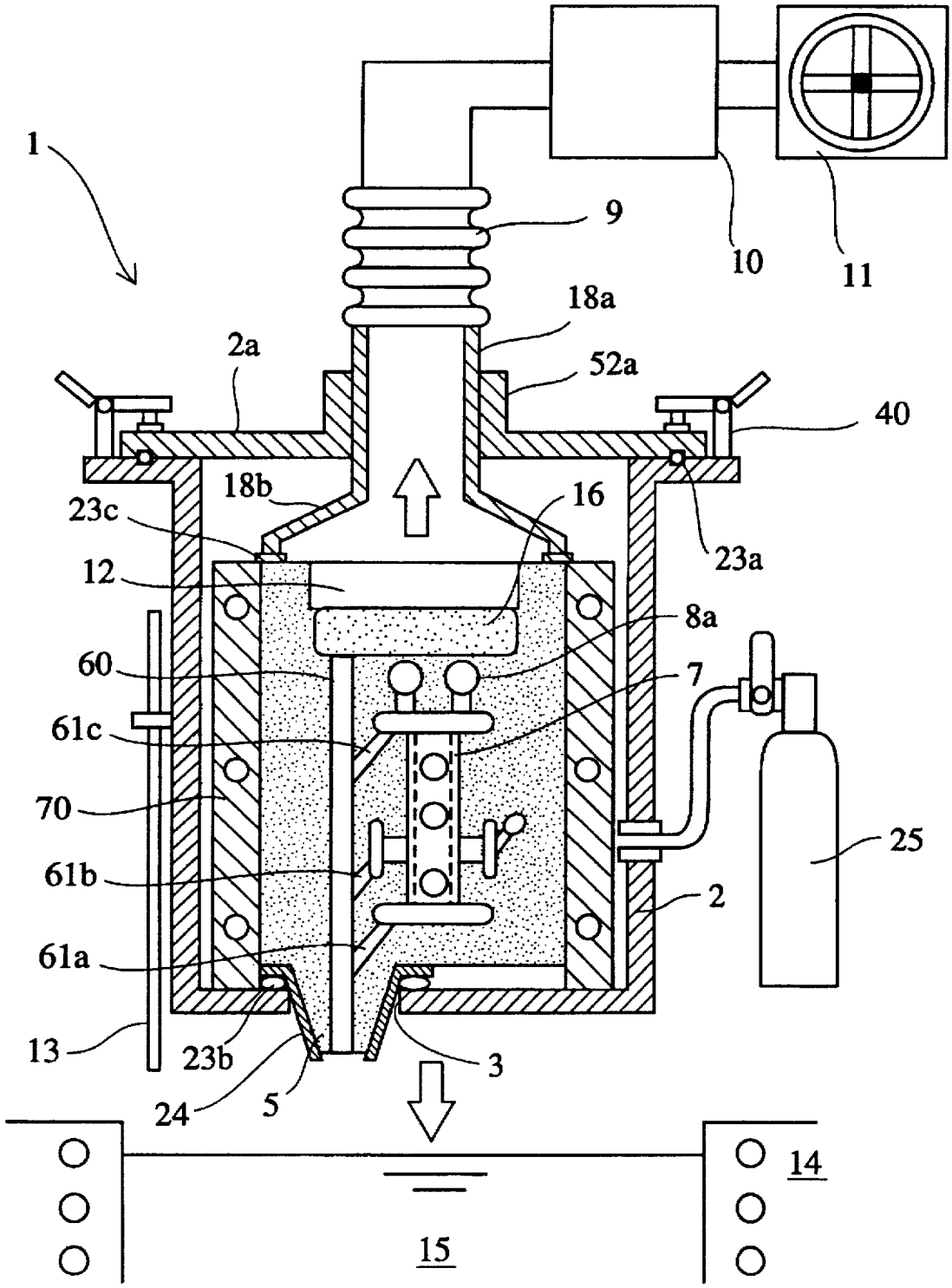
FIG. 5 is a partial cross sectional view showing a vacuum casting apparatus according to the second embodiment of the present invention.

In FIG. 5, the mold 4 has a runner 60 which extends, vertically for example, from the bottom of the molten metal entrance portion 5 to the vicinity of the suction recess 12 nearly along the side of the mold cavity 7. The runner 60 communicates with the mold cavity 7 via three filling passages 61*a*, 61*b* and 61*c* positioned along the length of the runner 60. Each of the filling passages 61*a*, 61*b* and 61*c* ascends toward the mold cavity 7 so that the joining portion of the filling passage with the mold cavity 7 is positioned upward the joining portion of the filling passage with the runner 60. The upper end of the runner 60 is preferred to be positioned higher than the riser, 8*a*. This enables the runner 60 to be maintained at a pressure slightly lower than the pressure in the mold cavity 7. With this structure, the front of the molten metal flow entering into the mold cavity 7 is scarcely disturbed, and the cavity 7 can be rapidly filled with the molten metal.

The vacuum casting apparatus of FIG. 5 may be operated in the same manner as in the vacuum casting apparatus shown in FIG. 1 except that the molten metal is rapidly introduced into the mold cavity 7 from the runner 60 through the filling passages 61*a*, 61*b* and 61*c*. At a certain stage of the evacuation, it is preferable to set the pressure in the runner 60 about 20 mmHg lower than the pressure of the mold cavity 7.

Figure 6:
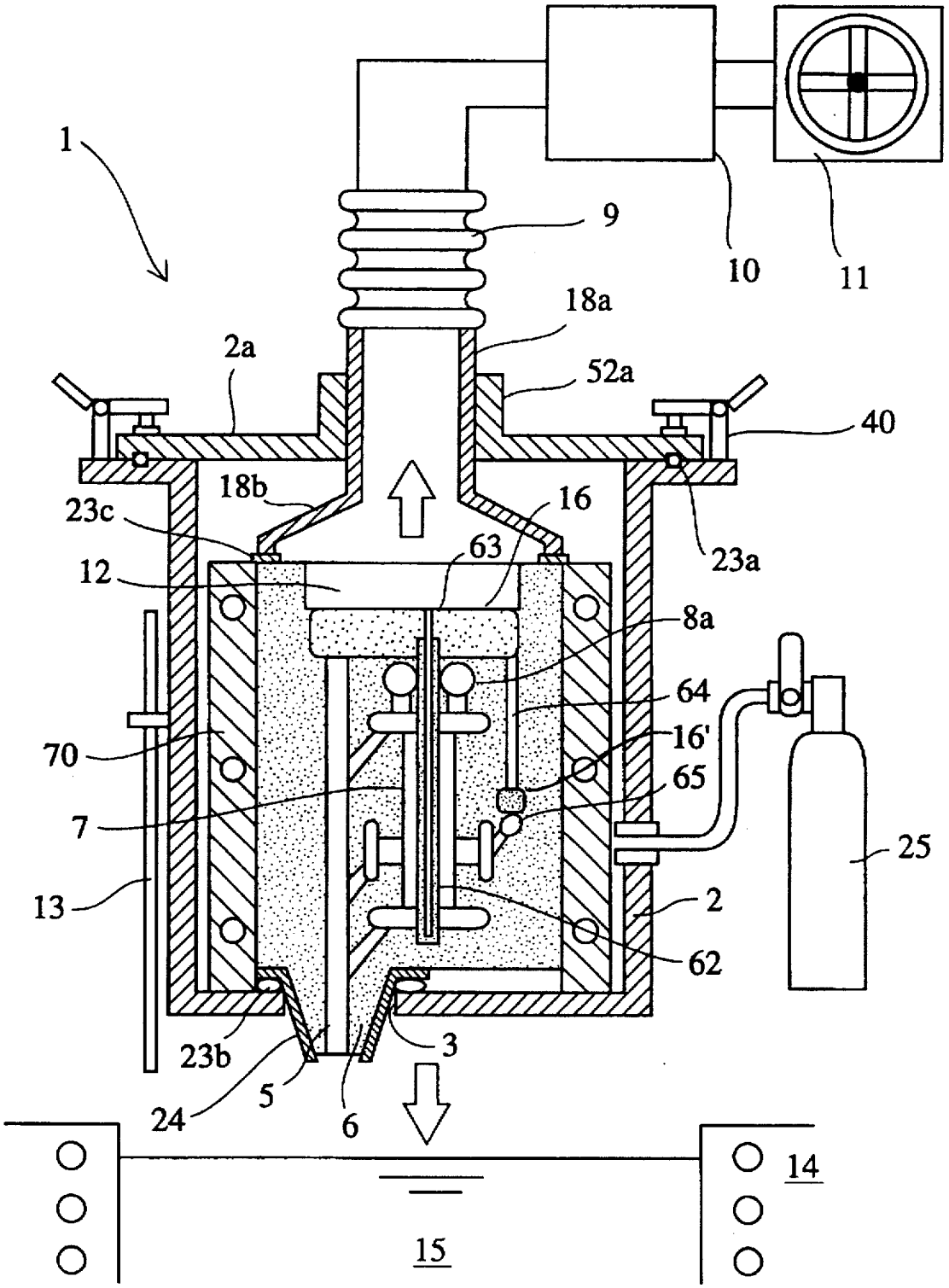
FIG. 6 is a partial cross sectional view showing another vacuum casting apparatus according to the second embodiment of the present invention.

FIG. 6 is a schematic cross sectional view showing another modified embodiment of the vacuum casting apparatus of the second embodiment. Since the basic construction of the apparatus of FIG. 6 is the same as that of the apparatus of FIG. 5, the description on the members commonly shown in FIGS. 5 and 6 is omitted here. In the vacuum casting apparatus of FIG. 6, a hollow core 62 is disposed within the mold cavity 7. Since the hollow space of the core 62 is communicated with the thin through-hole 63 vertically extending through the porous member 16 and opens at the bottom of the suction recess 12, the suction force directly acts to the interior of the core 62. The mold 4 has a narrow suction duct 64 extending from the bottom of the suction recess 12 to the vicinity of a last-to-fill portion 65 other than the riser 8*a*. A porous member 16' may be disposed between the last-to-fill portion 65 and the lower end of the suction duct 64. The hollow core 62 and the suction duct 64 aid in rapid and entire filling of the mold cavity 7 with the molten metal. The vacuum casting apparatus shown in FIG. 6 may be operated in the same manner as in the vacuum casting apparatus shown in FIG. 5.

Figure 8:
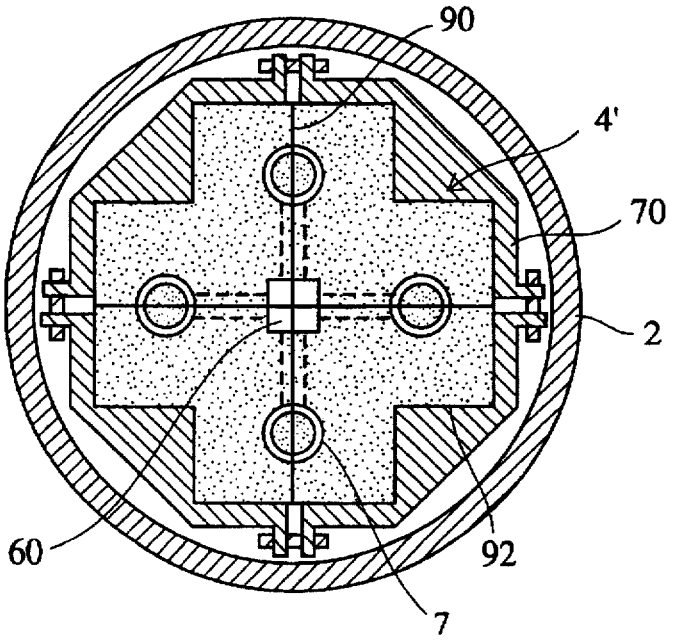
FIG. 8 is a cross sectional view taken along the line A—A of FIG. 7.
Figure 7:
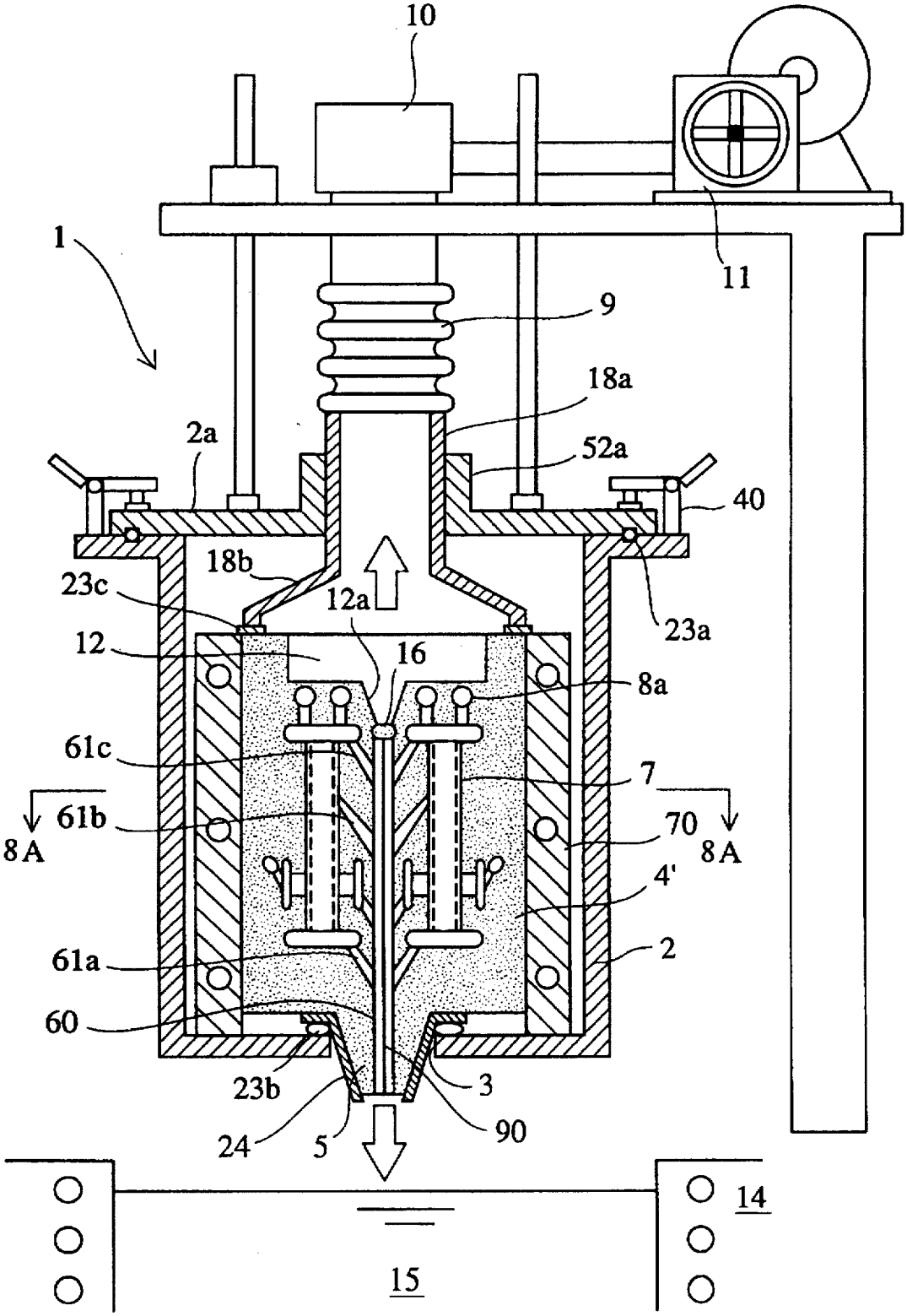
FIG. 7 is a partial cross sectional view showing a vacuum casting apparatus having a fabricated mold consisting of a plurality of split molds.

FIG. 7 is a schematic cross sectional view of a vacuum casting apparatus which has a fabricated mold 4' (multi-cavity mold) consisting of a plurality of split molds and provided with a plurality of mold cavities so as to produce a plurality of cast articles in one casting operation. FIG. 8 is a cross sectional view of the apparatus of FIG. 7 taken along the A—A line. In FIG. 8, although the mold 4' is fabricated from four split molds, the mold 4' may be fabricated from split molds other than four. The use of the split molds enables the successive operation from the production of mold to the casting, and make the handling of the product, etc. easier.

In FIG. 7, the suction recess 12 has a conical recess 12*a* at its bottom portion, and the porous member 16 having a gas-permeability higher than that of the body of the mold 4' is disposed beneath the lower end of the conical recess 12*a*. The runner 60 upwardly extends to the position just below the porous member 16 and communicates with a plurality of mold cavities 7 through the filling passages 61*a*, 61*b* and 61*c*. Each of the mold cavity 7 and the riser 8*a* may be of the same shape as those shown in FIG. 5. The parting plane 90 coincides with the vertical plane which includes the vertical center line passing through the runner 60 and divides each mold cavity into tow partings. As seen from FIG. 8, the fabricated mold 4' is divided into four split molds 92 of the same shape by two parting planes 90 which perpendicularly intersect each other. In the same manner, an n-cavity mold may be fabricated from n split molds. By the use of the fabricated mold mentioned above, the cost for producing patterns, molds, etc. can be reduced. The vacuum casting apparatus of FIG. 7 may be operated in the same manner as in the vacuum casting apparatus shown in FIG. 5.

Figure 9:
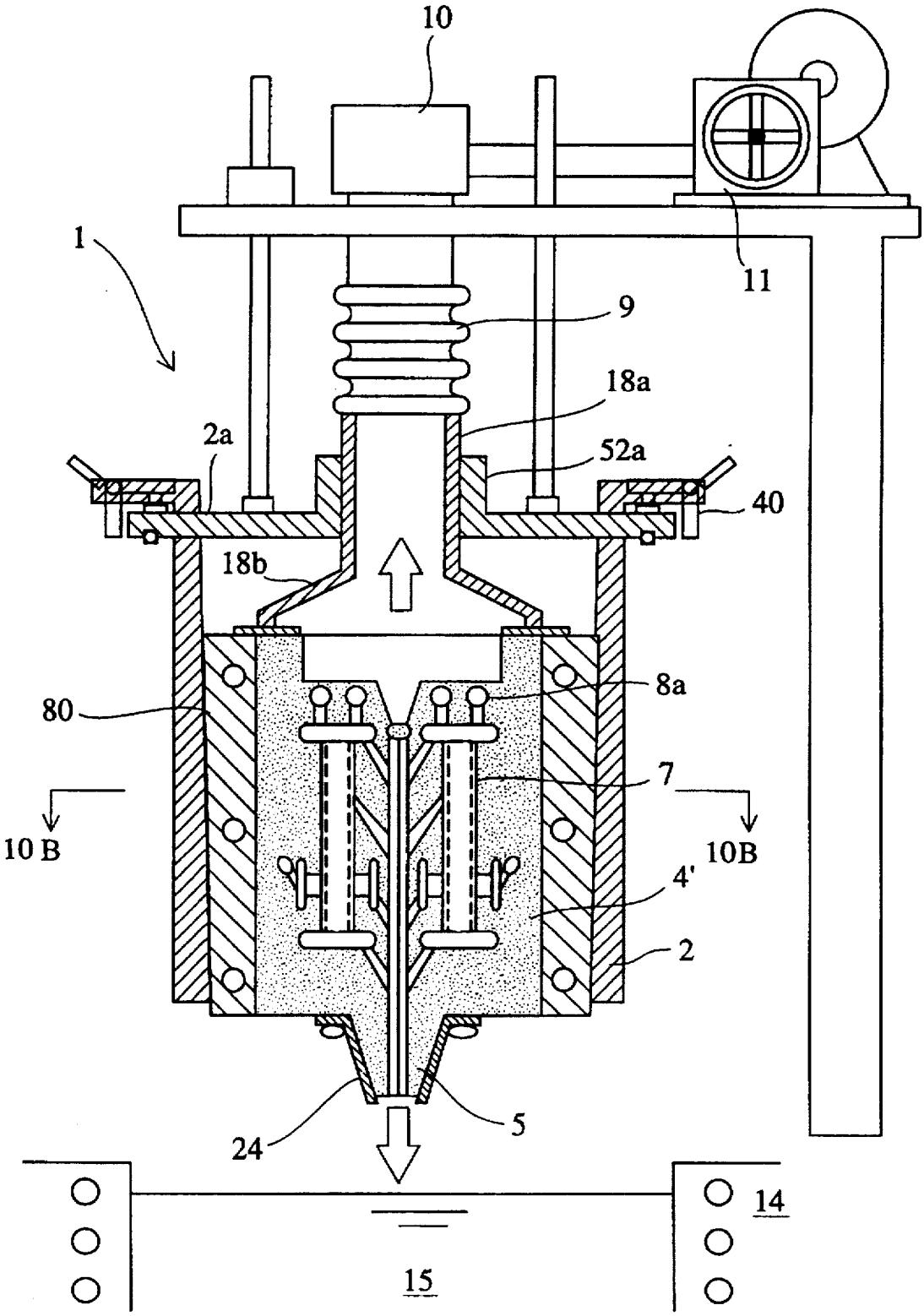
FIG. 9 is a partial cross sectional view showing a modified embodiment of the vacuum casting apparatus of FIG. 7.
Figure 10:
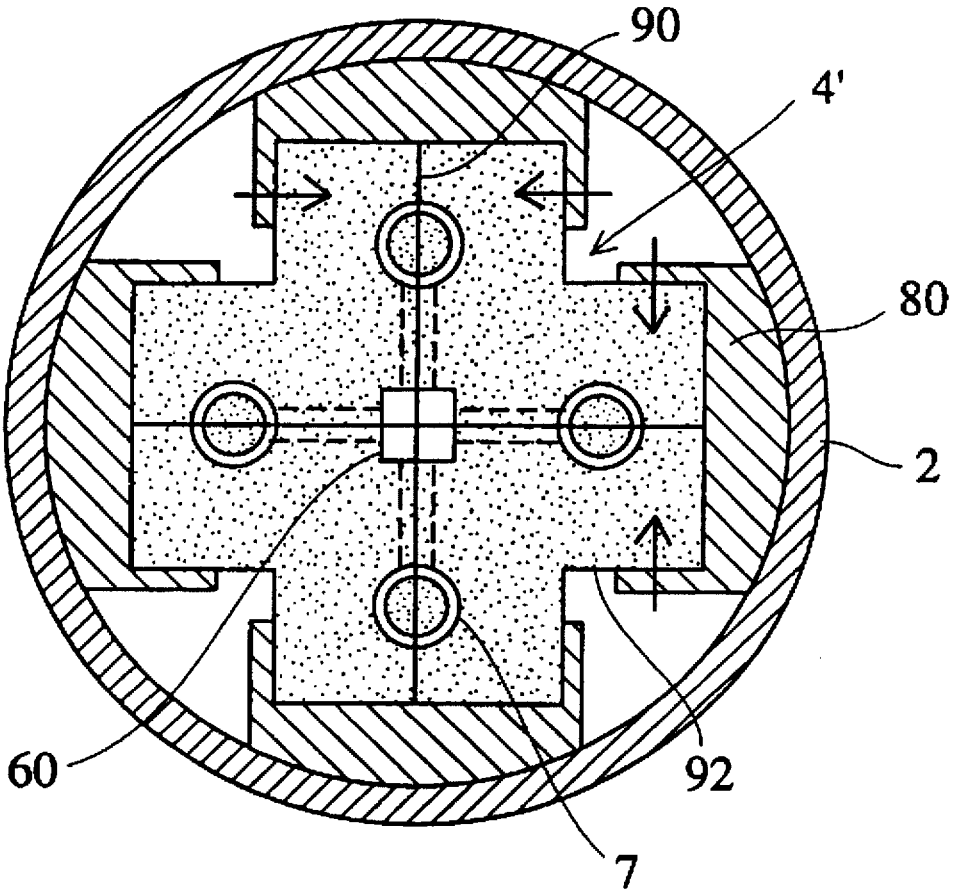
FIG. 10 is a cross sectional view taken along the line B—B of FIG. 9.

FIG. 9 is a schematic cross sectional view showing a modified embodiment of the vacuum casting apparatus of FIG. 7, and FIG. 10 is a cross sectional view thereof taken along the B—B line. Since the basic construction of the apparatus of FIG. 9 is the same as that of the apparatus of FIG. 7, the description on the members commonly shown in FIGS. 7 and 9 is omitted here. As seen from FIG. 10, the fabricated mold 4' is laterally supported by four U-shaped clamps 80. The clamp 80 is tapered toward the lower portion so that the upper portion is thicker than the lower portion. The wall of the mold support chamber 2 is also tapered so that the lower portion of the wall is thicker than the upper portion. In the vacuum casting apparatus with such a construction, when the suction head is pressed onto the mold 4', each of the split molds 92 is pressed toward the direction indicated by arrows in FIG. 10. The vacuum casting apparatus of FIG. 9 may be operated in the same manner as in the vacuum casting apparatus shown in FIG. 7.

The present invention will be further described while referring to the following Examples which should be considered to illustrate various preferred embodiments of the present invention.

EXAMPLE 1

A molten metal (1550° C.) having each composition shown in Tables 1 and 2 was cast by the vacuum casting apparatus shown in FIG. 1 to produce cast steels of various thicknesses of at least 2.5 mm. Any casting defects such as insufficient filling, under fill, etc. were not observed in the thin cast articles.

TABLE 1

| (weight %) | | | |
|---|---|---|---|
| C | Ni | Cr | Fe and impurities |
| 0.08 | 8.0 | 18.0 | balance |

TABLE 2

| (weight %) | | | |
|---|---|---|---|
| C | Ni | Cr | Fe and impurities |
| 0.32 | 16.0 | 22.0 | balance |

EXAMPLE 2

A molten metal (1580° C.) having each composition shown in Tables 1 and 2 was cast by the vacuum casting apparatus shown in FIG. 4 to produce cast steels of various thicknesses of at least 2.0 mm. Any casting defects such as insufficient filling, under fill, etc. were not observed in the thin cast articles.

EXAMPLE 3

A molten metal (1610° C.) having each composition shown in Tables 1 and 2 was cast by the vacuum casting apparatus shown in FIG. 5 to produce cast steels of various thicknesses of at least 1.5 mm. Any casting defects such as insufficient filling, under fill, etc. were not observed in the thin cast articles.

EXAMPLE 4

Figure 11:
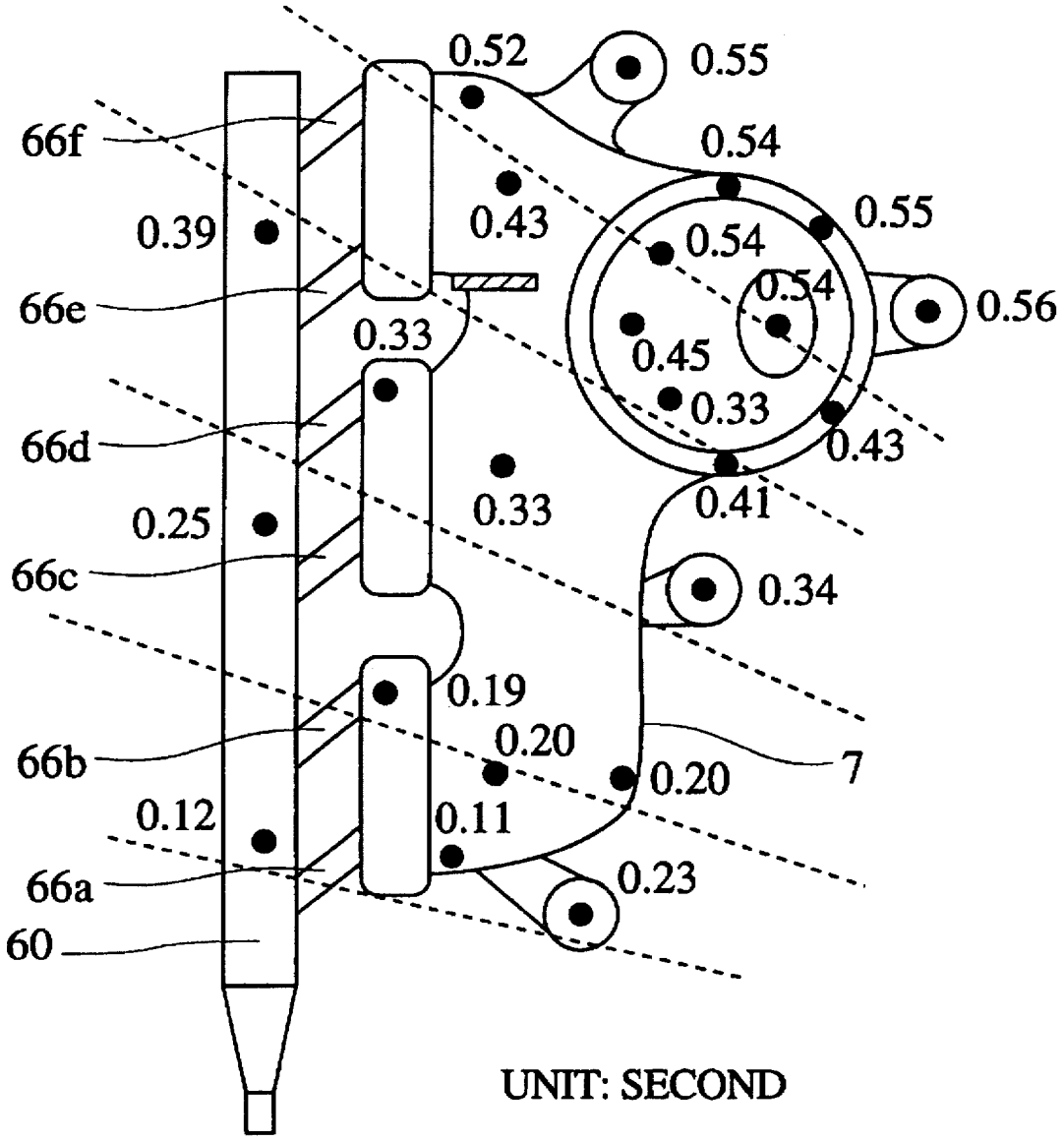
FIG. 11 is an illustration showing the filling manner of a cavity obtained by a measurement and a computer simulation.

By using the vacuum casting apparatus of FIG. 5, the mode of the molten metal flow in a mold for producing a manifold shown in FIG. 11 was observed and simulated by computer. The mold has a mold cavity 7 communicated with a runner 60 via six filling passages 66*a*–66*f*. The results are shown in FIG. 11. The numerical values therein means the time (measured by second) required for the molten metal flow to reach the respective positions in the mold cavity.

As seen from FIG. 11, the molten metal rising the runner 60 was first introduced into the lower portion of the cavity 7 through the first (lowest) filling passage 66*a*. Just before the front of the molten metal flow in the mold cavity 7 reached the same level as the upper end of the second filling passage 66*b*, the molten metal passing through the second filling passage 66*b* began to be introduced into the mold cavity 7. Thereafter, just before the front of the molten metal flow in the mold cavity 7 reached the same level as the upper end of the next filling passage, the molten metal passing through the next filling passage began to be introduced into the mold cavity 7. This filling process was successively repeated until the mold cavity 7 was entirely filled with the molten metal. The rising manner of the front of the molten metal flow is shown in FIG. 11 by broken lines.

Thus, since a molten metal with a little temperature lowering is successively poured on to the front of the molten metal already introduced into the mold cavity, the casting defects such as insufficient filling, leak defects, inclusion of air, blow holes, etc. can be effectively prevented.

Figure 12A:
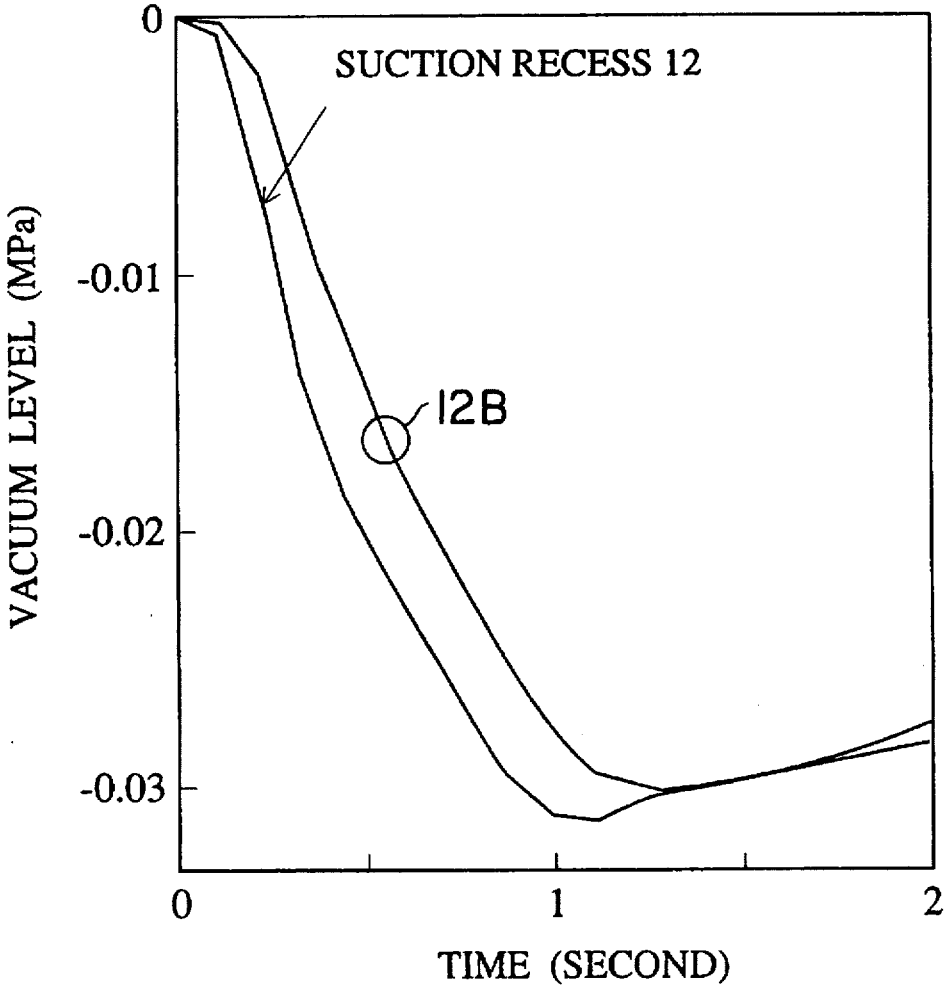
FIG. 12A and 12B are a graph showing vacuum degrees of several portions of the vacuum casting apparatus.
Figure 12B:
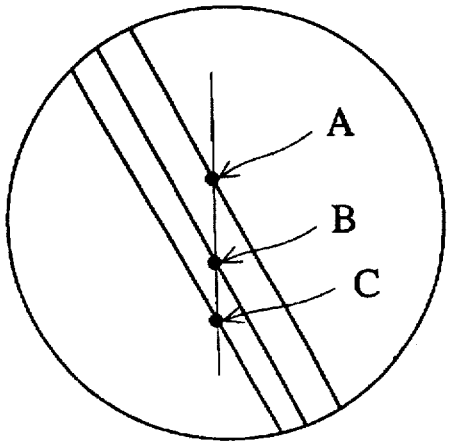

The vacuum degrees at several portions of the vacuum casting apparatus, which may fill the mold cavity 7 with the molten metal in a manner shown in FIG. 11, are shown in FIG. 12A and 12B. As seen from FIG. 12A and 12B, the filling of the mold cavity 7 with the molten metal was completed within about one second. Further, it can be seen that in this period of time, the vacuum in the suction recess 12 contributes to reducing the pressure in the runner 60 much more than reducing the pressure of the mold cavity 7. Namely, the runner 60 is more highly evacuated than the mold cavity 7. In order to provide the runner 60 with such a high vacuum degree, the top end of the vertically extending runner 60 along the mold cavity 7 is preferred to reach the vicinity of the suction recess 12.

As described above, in the vacuum casting method and vacuum casting apparatus of the present invention, a suction head slidably disposed at the upper opening of a mold support chamber is sealingly pressed onto the upper surface of a mold and a constant pressing force is applied to the suction head. With this structure, the suction head is maintained to sealingly fit to the upper surface of the mold and a desired pressing force can be applied to the mold in spite of a size tolerance in the mold or a size difference between the molds. Therefore, there is no necessity to replace the suction head with another or change the fixing position of the suction head depending upon the size of the mold to be used, this remarkably increasing the productivity of cast articles. In addition, an extremely thin cast article can be produced without casting defect such as insufficient filling, etc.

Since the vacuum casting apparatus and method of the present invention have technical advantages as described above, they are suitable for producing extremely thin cast articles of steel, in particular for producing exhaust equipment members such as manifold, etc.

What is claimed is:

1. A vacuum casting method comprising the steps of:

(a) disposing a mold having a runner and a mold cavity communicating with said runner in a mold support chamber having an upper opening and a bottom opening so that the lower open end of said runner is positioned below said bottom opening;

b) forming a preferential suction zone in the vicinity of a top portion of said mold cavity;

(c) placing a suction head in said upper opening of said mold support chamber so that the lower open end of said suction head completely covers said preferential suction zone and sealingly fits the outer upper surface of said mold while continuously applying a constant downward pressure to said mold by pushing said suction head downwardly with a pressing means which is cooperatively attached to said suction head; and (d) evacuating said mold through said preferential suction zone while pressing said mold toward the inner bottom surface of said mold support chamber by applying a downward pressure from said pressing means and a downward pressure which results from a difference between a pressure in said mold and a pressure in said mold support chamber surrounding said mold, thereby filling said mold cavity with a molten metal through said runner.

2. The vacuum casting method according to claim 1, wherein said preferential suction zone is a suction recess formed by cutting out the upper portion of said mold from the upper surface downwardly toward the top of said mold cavity, thereby shortening the distance between the top of said mold cavity and the surface of said mold.

3. The vacuum casting method according to claim 1, wherein said mold is laterally covered with a clamp, thereby fixedly supported in said mold support chamber.

4. The vacuum casting method according to claim 1, further comprising a step of disposing a porous member having a gas permeability higher than that of the body portion of said mold between said preferential suction zone and said mold cavity, thereby more rapidly filling said mold cavity with said molten metal.

5. The vacuum casting method according to claim 1, further comprising a step of providing a gas-permeable hollow core having an upper open end extending to the vicinity of said preferential suction zone in said mold cavity, thereby more rapidly evacuating said mold cavity through said hollow core.

6. The vacuum casting method according to claim 1, further comprising a step of providing at least one suction duct which is communicated with said preferential suction zone and extends in said mold to the vicinity of a hard-to-fill portion of said mold cavity, thereby sufficiently filling said hard-to-fill portion with said molten metal.

7. The vacuum casting method according to claim 1, wherein an atmosphere in said mold support chamber is replaced with an inert gas prior to evacuating said mold.

8. The vacuum casting method according to claim 1, wherein said mold is first evacuated at a low evacuating speed and then at a high evacuating speed after the pressure in said mold support chamber reaches a predetermined vacuum level, thereby introducing said molten metal into said mold cavity.

9. A vacuum casting apparatus comprising:

(a) a mold support chamber having an upper opening and a bottom opening, and being hermetically fitted to a cover at said upper opening by a sealing means;

b) a mold having a runner and a mold cavity communicating with said runner, said mold being disposed in said mold-support chamber so that the lower open end of said runner is positioned below said bottom opening;

(c) a preferential suction zone formed in the vicinity of the top of said mold cavity;

(d) a suction head slidably mounted through said cover, and placed in said upper opening of said mold support chamber so that the lower open end of said suction head completely covers said preferential suction zone and sealingly fits the outer upper surface of said mold;

(e) a pressing means for continuously and constantly pressing, in cooperation with said suction head, said mold toward the inner bottom surface of said mold support chamber; and (f) a vacuum means communicating with said suction head, for evacuating said mold to fill said mold cavity with said molten metal while pressing said mold toward the inner bottom surface of said mold support chamber.

10. The vacuum casting apparatus according to claim 9, wherein said preferential suction zone is a suction recess formed by cutting out the upper portion of said mold from the upper surface downwardly toward the top of said mold cavity so as to shorten the distance between the top of said mold cavity and the surface of said mold.

11. The vacuum casting apparatus according to claim 9, wherein said mold is laterally covered with a clamp so as to be fixedly supported in said mold support chamber.

12. The vacuum casting apparatus according to claim 9, further comprising a porous member having a gas permeability higher than that of the body portion of said mold, said porous member being disposed between said preferential suction zone and said mold cavity.

13. The vacuum casting apparatus according to claim 9, further comprising a gas-permeable hollow core extending in said mold cavity and having an upper open end communicating with said preferential suction zone through a narrow hole.

14. The vacuum casting apparatus according to claim 9, further comprising at least one suction duct which is communicated with said preferential suction zone and extends in said mold to the vicinity of a hard-to-fill portion of said mold cavity.

15. The vacuum casting apparatus according to claim 9, further comprising a gas-supplying means for replacing an atmosphere in said mold support chamber with an inert gas prior to evacuating said mold.

16. The vacuum casting apparatus according to claim 9, further comprising a pressure sensor for detecting the immersion of the lower open end of said runner into a molten metal pool by the change of the pressure in said mold support chamber.

17. A vacuum casting method comprising the steps of:

(a) disposing a mold having a runner and a mold cavity communicating with said runner through a plurality of filling passages in a mold support chamber having an upper opening and a bottom opening so that the lower open end of said runner is positioned below said bottom opening;

(b) forming a preferential suction zone in the vicinity of the top of said mold cavity;

(c) placing a suction head in said upper opening of said mold support chamber so that the lower open end of said suction head completely covers said preferential suction zone and sealingly fits the outer upper surface of said mold while continuously applying a constant downward pressure to said mold by pushing said suction head downwardly with a pressing means which is cooperatively attached to said suction head; and (d) evacuating said mold through said preferential suction zone while pressing said mold toward the inner bottom surface of said mold support chamber by applying a downward pressure from said pressing means and a downward pressure which results from a difference between a pressure in said mold and a pressure in said mold support chamber surrounding said mold, thereby filling said mold cavity with a molten metal through said runner.

18. The vacuum casting method according to claim 17, wherein said preferential suction zone is a suction recess formed by cutting out the upper portion of said mold from the upper surface downwardly toward the top of said mold cavity, thereby shortening the distance between the top of said mold cavity and the surface of said mold.

19. The vacuum casting method according to claim 17, wherein said mold is laterally covered with a clamp, thereby fixedly supported in said mold support chamber.

20. The vacuum casting method according to claim 17, further comprising a step of disposing a porous member having a gas permeability higher than that of the body portion of said mold between said preferential suction zone and said mold cavity, thereby more rapidly filling said mold cavity with said molten metal.

21. The vacuum casting method according to claim 17, further comprising a step of providing a gas-permeable hollow core having an upper open end extending to the vicinity of said preferential suction zone in said mold cavity, thereby more rapidly evacuating said mold cavity through said hollow core.

22. The vacuum casting method according to claim 17, further comprising a step of providing at least one suction duct which is communicated with said preferential suction zone and extends in said mold to the vicinity of a hard-to-fill portion of said mold cavity, thereby sufficiently filling said hard-to-fill portion with said molten metal.

23. The vacuum casting method according to claim 17, wherein an atmosphere in said mold support chamber is replaced with an inert gas prior to evacuating said mold.

24. The vacuum casting method according to claim 17, wherein said mold is first evacuated at a low evacuating speed and then at a high evacuating speed after the pressure in said mold support chamber reaches a predetermined vacuum level, thereby introducing said molten metal into said mold cavity.

25. A vacuum casting apparatus comprising:

(a) a mold support chamber having an upper opening and a bottom opening and being hermetically fitted to a cover at said upper opening by a sealing means;

(b) a mold having a runner and a mold cavity communicating with said runner through a plurality of filling passages, said mold being disposed in said mold support chamber so that the lower open end of said runner is positioned below said bottom opening;

(c) a preferential suction zone formed in the vicinity of the top of said mold cavity;

(d) a suction head slidably mounted through said cover and placed in said upper opening of said mold support chamber so that the lower open end of said suction head completely covers said preferential suction zone and sealingly fits the outer upper surface of said mold;

(e) a pressing means for continuously and constantly pressing, in cooperation with said suction head, said mold toward the inner bottom surface of said mold support chamber; and (f) a vacuum means communicating with said suction head, for evacuating said mold to fill said mold cavity with said molten metal while pressing said toward the inner bottom surface of said mold support chamber.

26. The vacuum casting apparatus according to claim 25, wherein said preferential suction zone is a suction recess formed by cutting out the upper portion of said mold from the upper surface downwardly toward the top of said mold cavity so as to shorten the distance between the top of said mold cavity and the surface of said mold.

27. The vacuum casting apparatus according to claim 25, wherein said mold is laterally covered with a clamp so as to be fixedly supported in said mold support chamber.

28. The vacuum casting apparatus according to claim 25, wherein said plurality of filling passages are spaced apart along the length of said runner and ascends toward said mold cavity, and each of said filling passages is configured and positioned so that the front of a rising molten metal in said mold cavity and the front of a molten metal to be poured on said rising molten metal from a next filling passage have nearly the same height.

29. The vacuum casting apparatus according to claim 25, wherein the upper end of said runner extends to the vicinity of said preferential suction zone.

30. The vacuum casting apparatus according to claim 25, further comprising a porous member having a gas permeability higher than that of the body portion of said mold, said porous member being disposed between said preferential suction zone and said mold cavity.

31. The vacuum casting apparatus according to claim 25, wherein said mold has at a lower portion thereof a molten metal entrance portion configured in an inverse frustoconical or cylindrical shape and projecting downward through said bottom opening of said mold support chamber, said molten metal entrance portion having on a lower surface thereof an opening of said runner and being covered with a protecting plate except for said lower surface.

32. The vacuum casting apparatus according to claim 25, further comprising a gas-permeable hollow core extending in said mold cavity and having an upper open end communicating with said preferential suction zone through a narrow hole.

33. The vacuum casting apparatus according to claim 25, further comprising at least one suction duct which is communicated with said preferential suction zone and extends in said mold to the vicinity of a hard-to-fill portion of said mold cavity.

34. The vacuum casting apparatus according to claim 25, further comprising a gas-supplying means for replacing an atmosphere in said mold support chamber with an inert gas prior to evacuating said mold.

35. The vacuum casting apparatus according to claim 25, further comprising a pressure sensor for detecting the immersion of the lower open end of said runner into a molten metal pool by the change of the pressure in said mold support chamber.

* * * * *